US010094141B2

(12) United States Patent
Helisten

(10) Patent No.: US 10,094,141 B2
(45) **Date of Patent: *Oct. 9, 2018**

(54) DOOR LOCK

(71) Applicant: ABLOY OY, Joensuu (FI)

(72) Inventor: Mika Helisten, Ylamylly (FI)

(73) Assignee: ABLOY OY, Joensuu (FI)

( * ) Notice: Subject to any disclaimer, the term of this patent is extended or adjusted under 35 U.S.C. 154(b) by 615 days.

This patent is subject to a terminal disclaimer.

(21) Appl. No.: 14/652,415

(22) PCT Filed: Nov. 1, 2013

(86) PCT No.: PCT/FI2013/051036
§ 371 (c)(1),
(2) Date: Jun. 15, 2015

(87) PCT Pub. No.: WO2014/096512
PCT Pub. Date: Jun. 26, 2014

(65) Prior Publication Data

US 2015/0330100 A1 Nov. 19, 2015

(30) Foreign Application Priority Data

Dec. 19, 2012 (FI) ..... 20126336

(51) Int. Cl.
*E05C 1/08* (2006.01)
*E05B 15/10* (2006.01)
(Continued)

(52) U.S. Cl.
CPC ..... *E05B 15/102* (2013.01); *E05B 15/108* (2013.01); *E05B 17/007* (2013.01);
(Continued)

(58) Field of Classification Search
CPC ..... Y10T 292/08; Y10T 292/096; Y10T 292/0969; Y10T 292/0977; Y10T 292/098; Y10T 292/0982; Y10T 292/1097
(Continued)

(56) References Cited

U.S. PATENT DOCUMENTS 242,247 A * 5/1881 Bailey ..... E05B 63/127 292/191
2,097,232 A * 10/1937 Hartman ..... E05L 317/0025 292/192
(Continued)

FOREIGN PATENT DOCUMENTS

CN 201070638 Y 6/2008
CN 101688406 A 3/2010
(Continued)

*Primary Examiner* — Carlos Lugo
(74) *Attorney, Agent, or Firm* — Muncy, Geissler, Olds & Lowe, P.C.

(57) ABSTRACT

The invention relates to a door lock having an oblique bolt. In the invention, stress of the parts of the oblique bolt susceptible to wear is reduced, wherein they remain functional longer. The oblique bolt consists of slanted surfaces on both sides such that the tip part is narrower at its tip than in the back part of the tip part. The tip part has recesses in its lower part and upper part, which extend from the tip to the back part. Both recesses are open at the end of the tip of the tip part and on the other slanted surface such that the recess of the upper part is open on the opposite slanted surface than the recess of the lower part. Both recesses have a turning piece.

11 Claims, 4 Drawing Sheets

Figure 1:
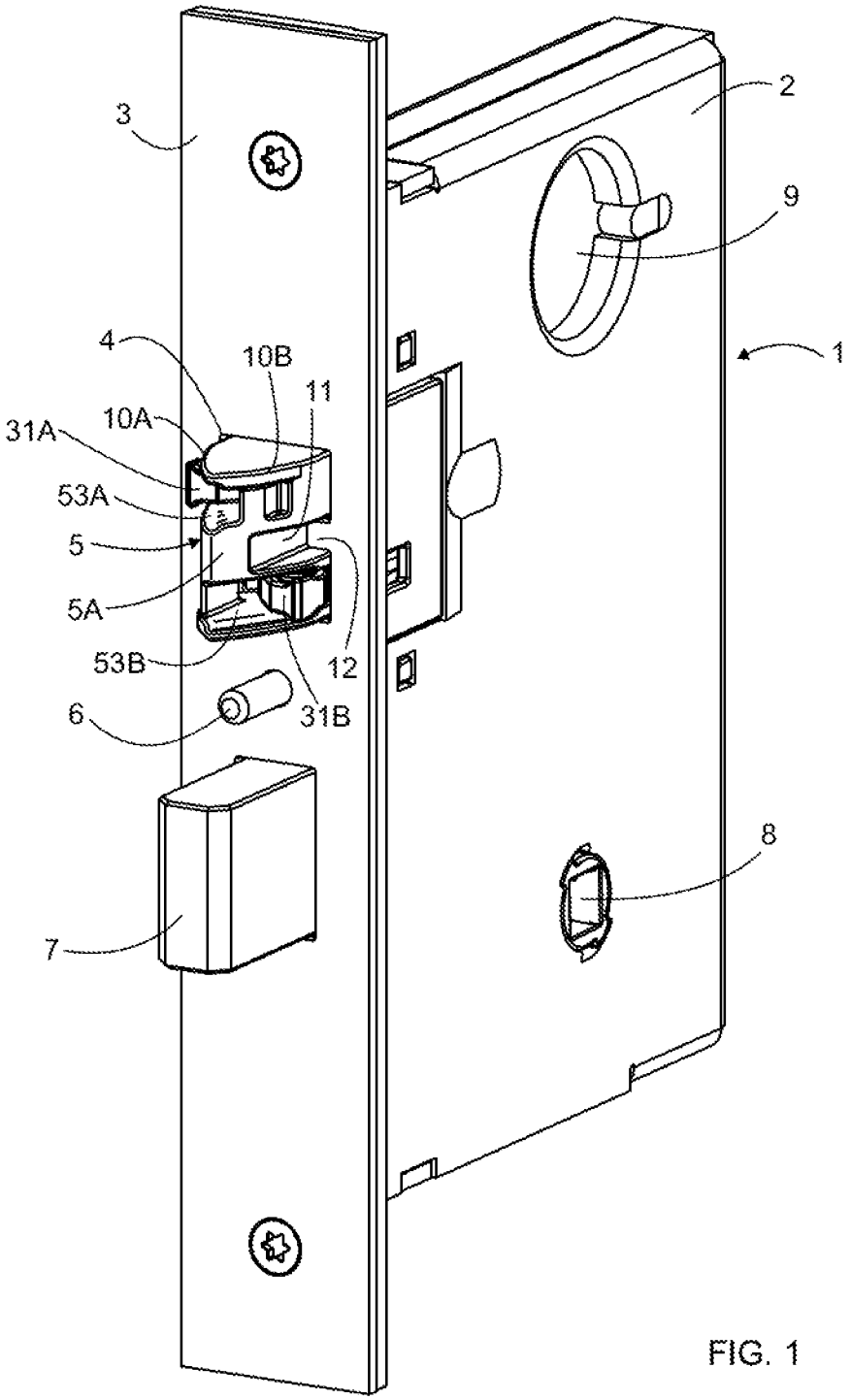

(51) Int. Cl.

| | |
|---|---|
| ***E05B 63/08*** | (2006.01) |
| ***E05B 55/00*** | (2006.01) |
| ***E05C 5/00*** | (2006.01) |
| ***E05B 17/00*** | (2006.01) |
| *E05C 1/00* | (2006.01) |
| *E05B 65/06* | (2006.01) |

(52) U.S. Cl.
CPC ..... *E05B 55/00* (2013.01); *E05B 63/08* (2013.01); *E05C 5/00* (2013.01); *E05B 65/06* (2013.01); *Y10T 292/08* (2015.04); *Y10T 292/0962* (2015.04); *Y10T 292/0969* (2015.04)

(58) Field of Classification Search
USPC ..... 292/2, 137, 163, 169
See application file for complete search history.

(56) References Cited

U.S. PATENT DOCUMENTS

| | | | | |
|---|---|---|---|---|
| 2,349,301 | A * | 5/1944 | Overby | E05L 317/007 292/169.21 |
| 2,622,908 | A * | 12/1952 | Lickteig, Jr. | E05B 63/04 292/244 |
| 2,631,051 | A * | 3/1953 | Lickteig, Jr. | E05B 63/04 292/244 |
| 2,726,890 | A * | 12/1955 | Teetor | E05C 3/162 292/192 |
| 3,107,112 | A | 10/1963 | Schlage | |
| 3,316,003 | A * | 4/1967 | Russell | E05L 363/044 292/219 |
| 3,492,038 | A * | 1/1970 | Fu | E05B 63/127 292/192 |
| 4,902,053 | A | 2/1990 | Hakkarainen et al. | |
| 5,113,676 | A * | 5/1992 | Panossian | E05B 55/12 292/18 |
| 6,349,982 | B2 | 2/2002 | Fayngersh et al. | |
| 6,390,515 | B1 * | 5/2002 | Huang | E05B 63/127 292/169.14 |
| 8,474,884 | B2 | 7/2013 | Helisten et al. | |
| 8,544,898 | B2 * | 10/2013 | Zimmer | E05B 15/0205 16/85 |
| 9,551,173 | B2 * | 1/2017 | Helisten | E05B 55/00 |
| 2009/0189399 | A1 | 7/2009 | Hodgin et al. | |

FOREIGN PATENT DOCUMENTS

| | | | |
|---|---|---|---|
| DE | 20 2006 010 747 | U1 | 12/2007 |
| EP | 0828047 | A2 | 3/1998 |
| EP | 1079054 | A1 | 2/2001 |
| FI | 82287 | | 10/1990 |
| FI | 120416 | B | 10/2009 |
| JP | S51-9590 | | 3/1976 |
| JP | 55-51947 | | 10/1978 |
| JP | H1-114765 | | 8/1989 |
| JP | 3-293491 | | 12/1991 |
| JP | H09151653 | A | 6/1997 |
| JP | 2007270449 | A | 10/2007 |
| JP | 2009197474 | A | 9/2009 |
| WO | WO 2007/027176 | A1 | 3/2007 |
| WO | WO 2009/014428 | A1 | 1/2009 |

* cited by examiner

DOOR LOCK

TECHNICAL FIELD

The invention relates to a door lock comprising an oblique bolt. In particular, the invention relates to door locks with oblique bolts, in which the oblique bolt contains moving bolt sections. Oblique bolts of this kind are often also called double action bolts.

PRIOR ART

Patent publications FI 82287 and FI 120416 present oblique bolt structures, which have an oblique bolt comprising bolt sections. These sections are arranged as moveable in relation to the other parts of the bolt. As was already stated, oblique bolts of this kind are also called double action bolts. In this text, both of these designations are used. As can be seen from the said patent publications, a double action bolt usually comprises a body part, which is provided with a longitudinal axis of the face plate of the door lock, and two bolt sections, which are pivotally supported into the body part around its axis.

Double action bolts of this kind are used in application sites, in which the door lock must be such that the door can be opened by pushing it in one direction or the other, when the deadlocking means of the door lock are in a passive state. By deadlocking means is meant the means in the lock, with which the bolt of the lock can be locked into the deadlocking position. In the deadlocking position, the bolt is in the extracted position from the body of the lock, and the bolt is unable to move inside the lock body.

From said publications is seen that both bolt sections have an oblique surface, which, as the door is placed shut, strikes against the striker plate, wherein the bolt section presses inside the lock body. The bolt sections are attached pivotally into the body of the double action bolt, wherein the bolt sections always form an oblique surface, which strikes against the striker plate as the door is turned shut or open, regardless of the direction, in which the door is turned. The striker plate presses therefore the bolt section into the same position with the other bolt section as the door is being shut or opened. In this case, the side surfaces of the bolt sections form a converging oblique surface. When the bolt is against the striker plate and partially in the opening of the striker plate (or the door is open), the bolt sections are in the position, in which the oblique bolt forms a dead bolt. If there are deadlocking means in the lock and they are placed to lock the oblique bolt into the extracted position, the oblique bolt functions therefore as a dead bolt. If the deadlocking means do not lock the oblique bolt, the oblique bolt functions as an oblique bolt in relation to both turning directions of the door.

The oblique bolts presented above need lubrication grease in order that they remain in good functioning condition. If the lubrication grease runs out, they begin to wear considerably faster than when lubricated. Wearing again causes functional disturbances.

BRIEF DESCRIPTION OF THE INVENTION

The objective of the invention is to obviate above said disadvantages and increase the functional reliability of the lock and the oblique bolt. The objectives are achieved in the manner presented in the independent claim. The dependent claims describe various embodiments of the invention. The invention is based on the idea that an attempt is made to reduce stress of the parts susceptible to wear, wherein they remain functional longer.

A door lock according to the invention comprises a lock body provided with a face plate, having an oblique bolt. The oblique bolt is spring-loaded towards the extracted position, and it comprises a tip part and a body part. The tip part is in the extracted position partially outside from the lock body, and it comprises slanted surfaces on both sides such that the tip part is narrower at its tip than in the back part of the tip part. The tip part has recesses in its lower part and upper part, which extend from the tip to the back part. Both recesses are open at the end of the tip of the tip part and on the other slanted surface such that the recess of the upper part is open on the opposite slanted surface than the recess of the lower part.

Both recesses have a turning piece comprising a bolt projection, which has a counter surface on its first side and a support surface on its other side. The turning piece also comprises a turning projection, which is arranged to turn the turning piece, when the oblique bolt moves from the retracted position into the extracted position. This occurs such that the turning projection is against the support surface on the inside of the face plate, when the counter surface moves away from the slanted surface of the tip part. Additionally, the turning piece comprises a push projection having a push surface towards the counter push surface of the back part of the recess and a curved turning surface on the other surface of the push projection towards the side surface of the recess.

The lock body has a roller on both sides of the oblique bolt between the side of the lock body and the side of the oblique bolt. The turning pieces are arranged to be with the bolt projection turned outwards from the slanted surfaces in the extracted position of the oblique bolt. In this case, the turning pieces form the edges of a deadbolt. The turning pieces are also arranged to turn from an external force directed onto the counter surface such that the push projection pushes the counter push surface using the push surface, causing the oblique bolt to move inward towards the lock body, and the turning surface turns in relation to the side of the recess, until the support surface of the bolt projection is against the other side surface of the recess.

LIST OF FIGURES

Figure 2:
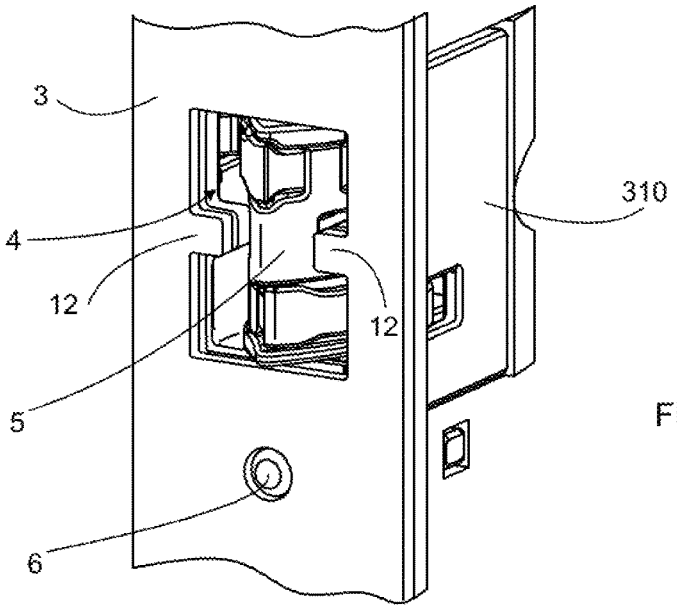
Figure 3:
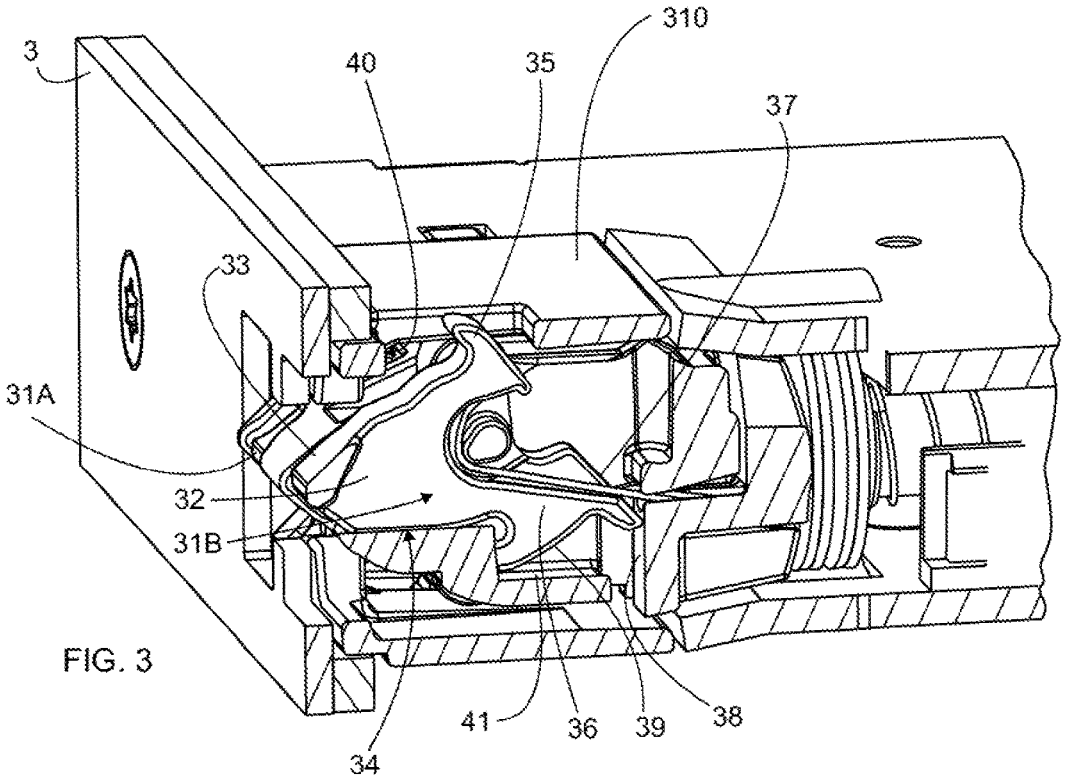
Figure 4:
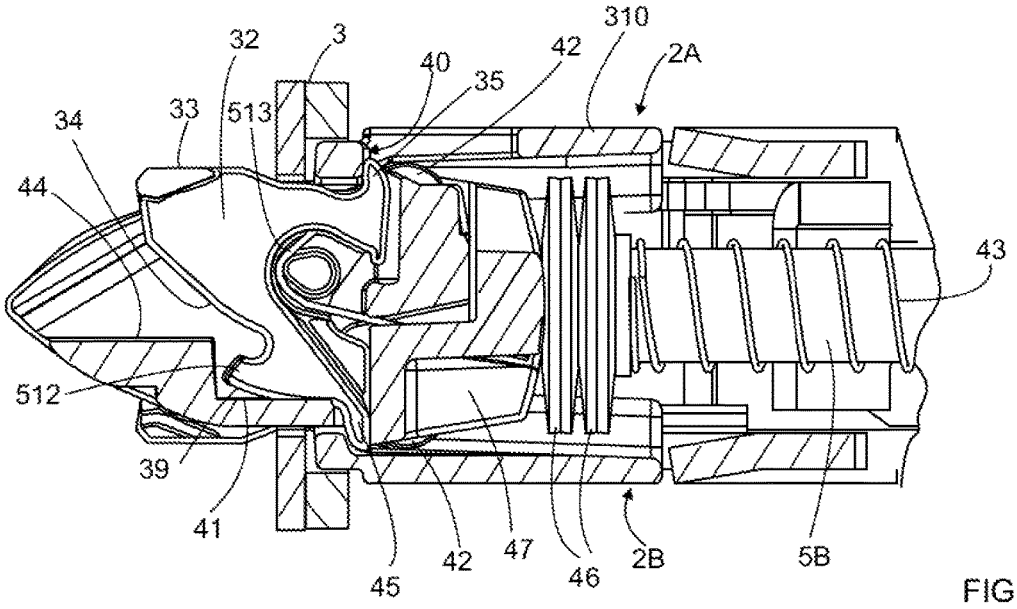
Figure 5:
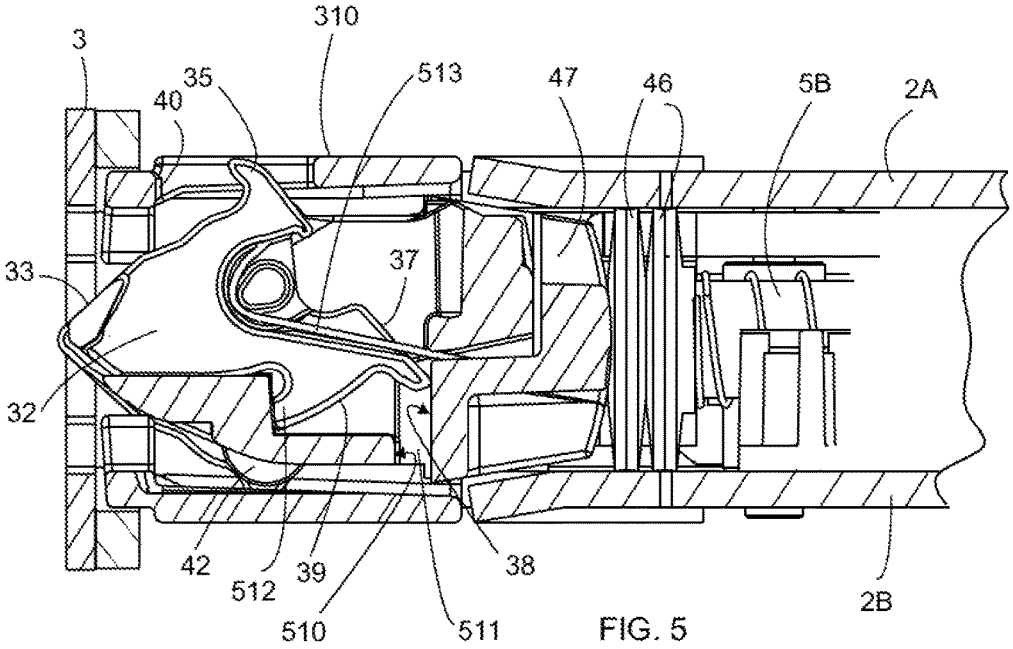
Figure 6:
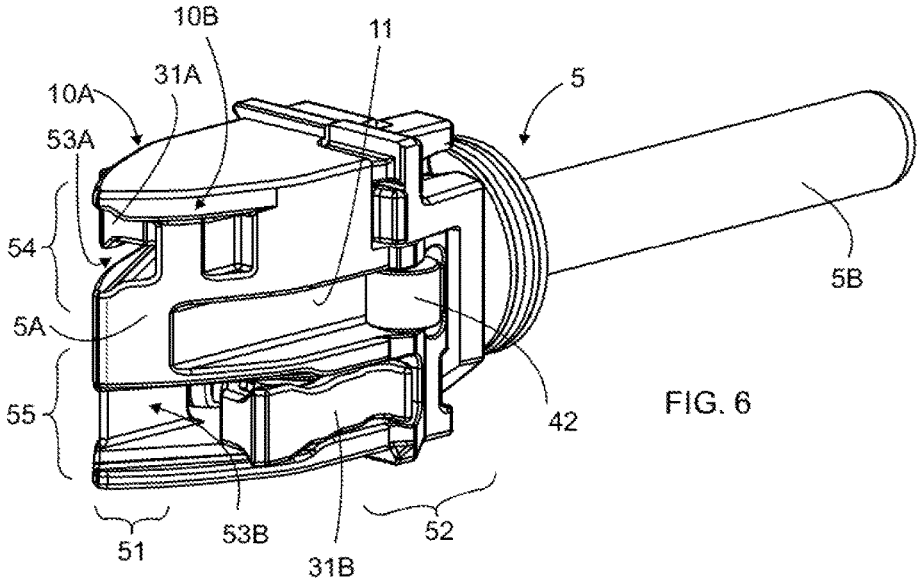
Figure 7:
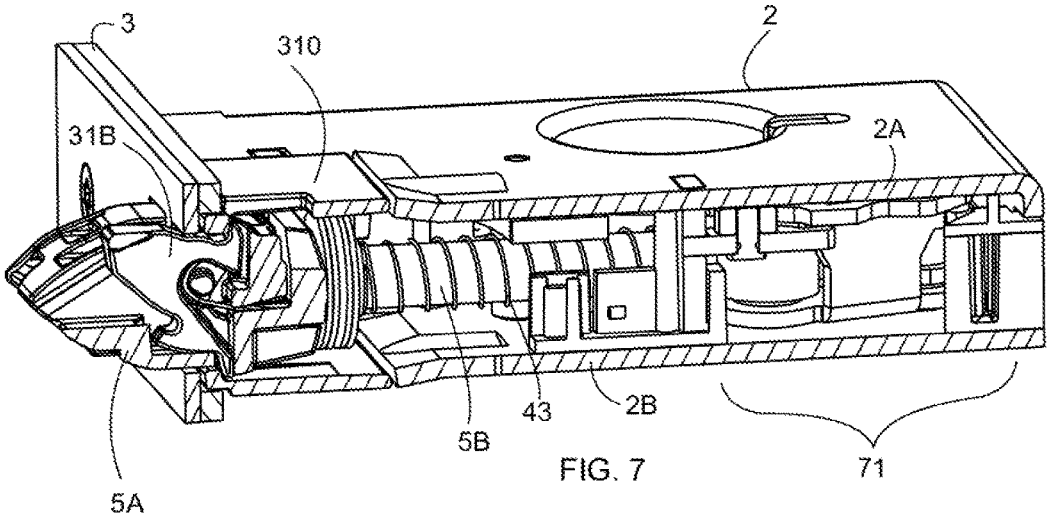

In the following, the invention is described in more detail by means of the figures of the accompanying drawings, in which FIG. 1 shows an example of a door lock according to the invention, FIG. 2 shows a part of the example of FIG. 1 with the oblique bolt inside the lock body, FIG. 3 shows a section of a lock according to the invention with the oblique bolt inside, FIG. 4 shows a section of a lock according to the invention with the oblique bolt outside, FIG. 5 shows another section of the lock with the oblique bolt inside, FIG. 6 shows an example of an oblique bolt according to the invention and FIG. 7 shows another section of the lock with the oblique bolt outside.

DESCRIPTION OF THE INVENTION

FIG. 1 shows an example of a door lock 1 according to the invention. The door lock comprises a lock body 2 and a face plate 3. The face plate has an opening 4 for the oblique bolt 5. Additionally, in this example, the lock comprises an auxiliary wedge 6 to indicate the position of the door in relation to the frame of the door and a deadbolt 7 to strengthen the deadlocking of the door, wherein deadlocking can be implemented by the combined effect of two bolts, i.e. by the oblique bolt and the deadbolt. In the figure can also be seen the hole 8 of the axis of the pushbutton or twist knob as well as the place 9, for example, for the lock cylinder/lock cylinder organs used by a key.

In FIG. 1, the oblique bolt 5 is outside, or in the extracted position from the lock body. In FIG. 2, which shows a part of FIG. 1, the oblique bolt is inside, or in the retracted position. FIGS. 3 and 5 also show the retracted position of the oblique bolt. FIGS. 4 and 7 show additionally the oblique bolt in the extracted position.

The oblique bolt is then to be moved back and forth in a linear movement between the retracted position and the extracted locking position from the lock body 2 through the bolt hole 4 in the face plate 3. The oblique bolt 5 is spring-loaded towards said extracted position, and it comprises a tip part 5A and a body part 5B (see FIG. 6.). The tip part is in the extracted position partially outside from the lock body.

The tip part 5A comprises slanted surfaces 10A, 10B on both sides such that the tip part is narrower at its tip 51 than in the back part 52 of the tip part. In the example of the figures, the slanted surfaces comprise slight curvature/portions at different angles. The slanted surfaces can also be formed as planar surfaces. The tip part has recesses 53A, 53B in its lower part 55 and upper part 54. The recesses extend from the tip 51 of the tip part to the back part 52 of the tip part. Both recesses are open at the end of the tip 51 of the tip part and on the other slanted surface 10A, 10B such that the recess of the upper part is open on the opposite slanted surface than the recess of the lower part. The figures clarify, how the recesses are open on opposite slanted surfaces.

Both recesses 53A, 53B have a turning piece 31A, 31B comprising a bolt projection 32, which has a counter surface 33 on its first side and a support surface 34 on its other side. The turning piece also comprises a turning projection 35, which is arranged to turn the turning piece, when the oblique bolt moves from the retracted position into the extracted position. This occurs as pushed by the spring 43 affecting the oblique bolt such that the turning projection is against the support surface 40 on the inside of the face plate 3, and the counter surface 33 of the bolt projection moves away from the slanted surface 10A, 10B of the tip part. The turning piece further comprises a push projection 36, which has a push surface 37 towards the counter push surface 38 of the back part of the recess, and a curved turning surface 39 on the other surface of the push projection 36 towards the side surface 41 of the recess. Additionally, the counter surface 33 of the bolt projection of the turning piece can comprise a portion wider than the remaining turning piece.

The lock body has a roller 42 on both sides of the oblique bolt 5 between the side 2A, 2B of the lock body and the side of the oblique bolt. The rollers produce the easy movement of the oblique bolt between the extracted and retracted position. The turning pieces 31A, 31B are arranged to be with the bolt projection 32 turned outwards from the slanted surfaces 10A, 10B in the extracted position of the oblique bolt, and to turn from an external force directed onto the counter surface 33 such that the push projection 36 pushes the counter push surface 38 using the push surface, causing the oblique bolt to move inward towards the lock body, and the turning surface 39 turns in relation to the side of the recess, until the support surface 34 of the bolt projection is against the other side surface 44 of the recess. I.e., the turning piece cannot turn any more in this direction.

FIGS. 2, 3 and 5 show the oblique bolt in the retracted position, in which the support surface 34 of the bolt projection of the turning piece 31B is against the other side surface 44 of the recess. The counter surface 33 is in the plane of the slanted surface 10B of the tip part. Depending on the design of the tip part and the turning parts, the counter surface is approximately or precisely in the plane of the slanted surface. The implementation can also be such that the counter surface is partially precisely in the plane of the slanted surface and for its other parts approximately. Next will be examined the function of the oblique bolt in its different positions.

The oblique bolt 5 is spring-loaded by a spring 43 towards the extracted position. In this case, the turning projection 35 is against the support surface 40 on the back side of the face plate. When the oblique bolt has rolled, as supported by the rollers 42, towards the extracted position, the turning piece is turned in the recess 53B into the position of FIG. 4 as pushed by the counter push surface 38 and as supported/turned by the support surface 40. As is observed, the counter surfaces 33 of the turning pieces are outward from the plane formed by the slanted surfaces, wherein the turning pieces form a structure comparable to a deadbolt. If the deadlocking means 71 (FIG. 7) of the lock are placed into the locking position, the bolt cannot be pushed inside the lock body.

When the deadlocking means 71 are not placed into the locking position, the oblique bolt is able to move inside the lock body 2. As the door is opened, the striker plate in the frame of the door presses the counter surface 33 of the bolt projection. Due to this external force, the bolt projection 31B turns in the recess 53B of the tip part such that the counter surface moves towards the slanted surface 10B, the curved surface 39 of the push projection turns on the side 41 of the recess, and the push surface 37 of the push projection pushes the oblique bolt 5 inside the lock body 2 against the force of the spring 43. The turning piece turns, until it has turned such that its support surface 34 is completely against the other side surface 44 of the recess. As can be observed, the turning piece pushes the oblique bolt inside the lock body at the same time as it turns in the recess. Only thereafter, when the support surface of the turning piece is completely against the other side surface of the recess, the striker plate of the frame presses in a direct manner the tip part of the oblique bolt, either in direct contact or via the turning piece, wherein the function corresponds to known oblique bolts, and the tip part moves deeper into the lock body into the retracted position. The turning piece therefore no longer turns in the final stage, when the oblique bolt moves inward in the lock body.

Because the oblique bolt is supported via rollers 42 into the lock body, and turning pieces 31A, 31B turn in the recess 53A, 53B, the wear to which the surfaces are subjected can be reduced and the movement of the oblique bolt is made easier than before. When the side surface of the recess is composed from two parts—from the side surface 41 and the other side surface 44—the rolling of the turning piece is also composed from two parts, wherein the rolling distance is made larger than with a uniform rolling portion. In the example of the figures, the oblique bolt 5 is therefore arranged to turn from an external force directed onto the counter surface 33 initially on the curved surface 39 of the push projection, which is against the side surface 41 of the recess, and thereafter on the support surface 34 of the bolt projection 34, until it is completely turned against the other side surface 44 of the recess. In the embodiment of the figures, the turning piece turns on the support surface of the bolt projection at its other end, which is the end on the side of the back part 52 of the tip part of the bolt. When the bolt piece is as turned against the other side surface 44 of the recess, the end of this support surface 34 is somewhat separate from the other side surface 44.

The push projection 36 of the turning piece 31A, 31B can comprise a nose 45, whose other side is included as a part of said push surface 37. In such an embodiment, the back part of the tip part has a rear surface 510 towards the counter push surface 38 such that there is a gap 511 between the rear surface and the counter push surface. The nose 45 is located in the gap, when the oblique bolt is in the extracted position. The push projection 36 of the turning piece can also comprise another nose 512 at the end of the curved turning surface 39. The other nose is towards the tip 51 of the tip part in the manner shown in the figures.

In the oblique bolt can be obtained additional functional reliability, when to it are added springs 513 for each of the turning pieces. The spring specific to a turning piece is arranged to turn the bolt projection 32 towards the other side surface 44 of the recess. With the aid of the springs, also the opposite turning piece turns in the direction of the recess, when the striking plate presses the turning piece of the other side, and the oblique bolt 5 tries to move inside the lock body.

It is possible to place the above said rollers 42, for example, in the grooves 11 formed on both sides of the oblique bolt, in which the rollers are located. In such an embodiment, the bolt hole 4 has projections 12, which extend into the grooves.

It is also possible to form an embodiment according to the example of the figures, in which the lock body 2 comprises at the site of the oblique bolt 5 a body piece 310, against which the rollers 42 are located. Said support surface 40 on the inside of the face plate 3 for the turning projection 35 is also handy to arrange into the body piece. Use of the body piece can improve the assembly of the lock and facilitate production of the lock. Additionally, the roller characteristics of the rollers can better be controlled. If the invention is implemented without a body piece, the counter surface 40 is a part of the back surface (surface towards the lock body 2) of the face plate or possibly a part of the inner surface of the lock body for that part of the lock body 2, which is bent against the face plate 3. In the embodiment of the figures, the face plate is formed from two parts, but it can also be formed from one part.

The oblique bolt arrangement presented above is suitable for use in lock bodies having or not having deadlocking means. If the lock has deadlocking means 71, as FIG. 7 shows, then, in that case, the oblique bolt 5 can further comprise flexing organs 46 and a support piece 47 in the back part of the tip part. In this case, the support piece has said counter push surface 38. The support piece is located between the flexing organs 46 and the turning pieces 31A, 31B. Using the flexing organs and the support piece, which is movable in relation to the remaining tip part 5A, the force which is directed into the deadlocking means 71 can be decreased. In the embodiment of the figures, the flexing organs are disc springs. The oblique bolt can, however, be implemented also without a support piece and flexing organs, wherein the back part 53 of the tip part is a fixed part of the remaining tip part.

The structures of an oblique bolt according to the invention enable the easy movement of the oblique bolt, which reduces the need for lubrication. Hence, maintenance intervals of the lock can even be increased. Due to the structures, the function is more reliable than in known solutions, and the lock has a longer service life. The opening and closing forces of the door transmitted from the striker plate of the door frame to the oblique bolt are transmitted by the turning of the turning pieces as the linear movement of the oblique bolt. The turning pieces therefore roll against the tip part of the oblique bolt, wherein friction is less than in the case, in which the turning pieces were to slide against the tip part. The turning pieces therefore function both as transmitters of force and as supporting parts. The rollers on both sides of the oblique bolt also promote the oblique bolt moving easily in the linear direction.

In the light of the examples presented above, it is obvious that an embodiment according to the invention can be achieved by many various solutions. The shape of the tip part of the oblique bolt and the shape of the bolt pieces can vary. It is obvious that the invention is not limited only to examples mentioned in this text, rather it can be implemented by many various embodiments within the scope of the independent claim.

The invention claimed is:

1. A door lock comprising:

a lock body;

a face plate, the face plate including a bolt hole;

an oblique bolt, which is to be moved back and forth in a linear movement between a retracted position and an extracted locking position from the lock body through the bolt hole in the face plate and which oblique bolt is spring-loaded towards said extracted position, the oblique bolt comprising:

a tip part, the tip part being in the extract position partially outside from the lock body, the tip part comprising:

a tip;

slanted surfaces on both sides such that the tip part is narrower at the tip than in a back part of the tip part;

recesses in a lower part and an upper part of the tip part, said recesses extending from the tip to the back part, the recesses being open at an end of the tip of the tip part and on one slanted surface such that the recess of the upper part is open on an opposite slanted surface than the recess of the lower part, said recesses each having a turning piece comprising:

a bolt projection, the bolt projection comprising:

a counter surface on a first side of the bolt projection; and a support surface on another side of the bolt projection; and a turning projection, which is arranged to turn the turning piece, when the oblique bolt moves from the retracted position into the extracted position such that the turning projection is against a support surface on the inside of the face plate, and such that the counter surface moves away from the slanted surface of the tip part, the turning piece further comprising a push projection having a push surface towards a counter push surface of the back part of the recess and a curved turning surface on the other surface of the push projection towards a side surface of the recess; and a body part; and a roller disposed in the lock body at both sides of the oblique bolt, between sides of the lock body and the sides of the oblique bolt, wherein said turning pieces are arranged to be with the bolt projection turned outwards from the slanted surfaces in the extracted position of the oblique bolt, and to turn from an external force directed onto the counter surface such that the push projection pushes the counter push surface using the push surface, causing the oblique bolt to move inward towards the lock body, and the turning surface turns in relation to the side of the recess, until the support surface of the bolt projection has settled against another side surface of the recess.

2. A door lock according to claim 1, wherein the push projection of the turning piece comprises a nose, whose other side is included as a part of said push surface, and the back part of the tip part has a rear surface towards the counter push surface such that there is a gap between the rear surface and the counter push surface, in which the nose is located, when the oblique bolt is in the extracted position.

3. A door lock according to claim 2, wherein the push projection of the turning piece comprises another nose at the end of the curved turning surface, which is towards the tip of the tip part.

4. A door lock according to claim 1, wherein the oblique bolt comprises springs for each of the turning pieces, which spring specific to a turning piece is arranged to turn the bolt projection towards the other side surface of the recess.

5. A door lock according to claim 1, wherein the oblique bolt is arranged to turn from an external force directed onto the counter surface initially on the curved surface of the push projection, which is against the side surface of the recess, and thereafter on the support surface of the bolt projection, until it is completely turned against the other side surface of the recess.

6. A door lock according to claim 1, wherein when the support surface of the bolt projection is against the other side surface of the recess from an exterior force directed onto the counter surface, the counter surface is approximately or precisely in the plane of the slanted surface of the tip part.

7. A door lock according to claim 1, wherein on both sides of the oblique bolt is a groove, in which the roller is located, and the bolt hole has projections, which extend into the groove.

8. A door lock according to claim 7, wherein the lock body comprises at the site of the oblique bolt a body piece, against which the rollers are located, and which has said support surface on the inside of the face plate for the turning projection.

9. A door lock according to claim 1, wherein the counter surface of the bolt projection comprises a portion wider than the remaining turning piece.

10. A door lock according to claim 9, wherein the lock body comprises deadlocking means.

11. A door lock according to claim 10, wherein the rear part of the tip part has flexing organs and a support piece, which has said counter push surface and which is located between the flexing organs and the turning pieces.

* * * * *